United States Patent [19]

Neugent

[11] 4,305,376

[45] Dec. 15, 1981

[54] DEVICE FOR REMOVING ASHES FROM A BURNING FIRE

[76] Inventor: Walter F. Neugent, 6 Charles Ave., Westerly, R.I. 02891

[21] Appl. No.: 129,475

[22] Filed: Mar. 11, 1980

Related U.S. Application Data

[63] Continuation-in-part of Ser. No. 919,929, Jun. 28, 1978, abandoned.

[51] Int. Cl.[3] ..... F23J 1/00

[52] U.S. Cl. ..... 126/242; 126/244; 209/376; D7/210

[58] Field of Search ..... 126/244, 243, 242; 15/257.6; 294/50.8; D7/210; 110/165 R; 209/376, 377

[56] References Cited

U.S. PATENT DOCUMENTS

| | | | |
|---|---|---|---|
| 379,322 | 3/1888 | Murphy | 126/243 UX |
| 507,826 | 10/1893 | Miller | 15/257.6 X |
| 1,165,574 | 12/1915 | Davidson | 209/377 X |
| 1,554,525 | 9/1925 | Ricci | 126/244 UX |

FOREIGN PATENT DOCUMENTS

| | | | |
|---|---|---|---|
| 330389 | 2/1934 | Netherlands | 126/242 |
| 619343 | 9/1935 | Netherlands | 126/242 |
| 2550 | of 1885 | United Kingdom | 126/243 |

*Primary Examiner*—Samuel Scott
*Assistant Examiner*—Randall L. Green
*Attorney, Agent, or Firm*—Barlow & Barlow

[57] ABSTRACT

A shovel-like device for removing ashes from a burning fire while screening out solid burning particles which remain in the fire.

5 Claims, 4 Drawing Figures

DEVICE FOR REMOVING ASHES FROM A BURNING FIRE

CROSS REFERENCE TO RELATED APPLICATION

This application is a continuation-in-part of my earlier filed application Ser. No. 919,929, filed June 28, 1978 and abandoned.

BACKGROUND OF THE INVENTION

Shovel-like devices have been utilized for removing burning coals or other material for transporting the burning coals from one location to another and in some cases there has been a screening action in the removing shovel for the separation of ashes from the burning material, but the device has not been capable of screening the burning material so that it drops back into the fire. One of such devices is shown in British Pat. No. 235,679. In other cases, such as in U.S. Pat. No. 995,913, June 20, 1911, trays have been placed in stoves and there has been a screening of the ashes and a catching of solid material at the same time, but there was no way for the solid material to be discharged back into the stove. In other instances, such as in U.S. Pat. No. 507,826, shovels have been provided for collecting ashes with a cover to prevent the ashes from blowing or being discharged from the shovel, but no screening has been provided, merely a closure to keep the contents of the shovel including ashes and cinders within the shovel.

SUMMARY OF THE INVENTION

A shovel-like device is provided with a bottom and side walls and a cover which is foraminated and the cover and body of the device are tapered at the forward end so that the shovel-like device may be pushed into the fire such as one built upon a flat surface with no grate, and the ashes along the flat surface collected in the body of the shovel passing through the foraminated cover and such solid particles as may be burning and collected on the outer surface of the foraminated cover may be discharged back into the fire by merely tipping or tilting the shovel and its cover so that they slide off the top surface of the cover.

DESCRIPTION OF THE PREFERRED EMBODIMENT

Figure 1:
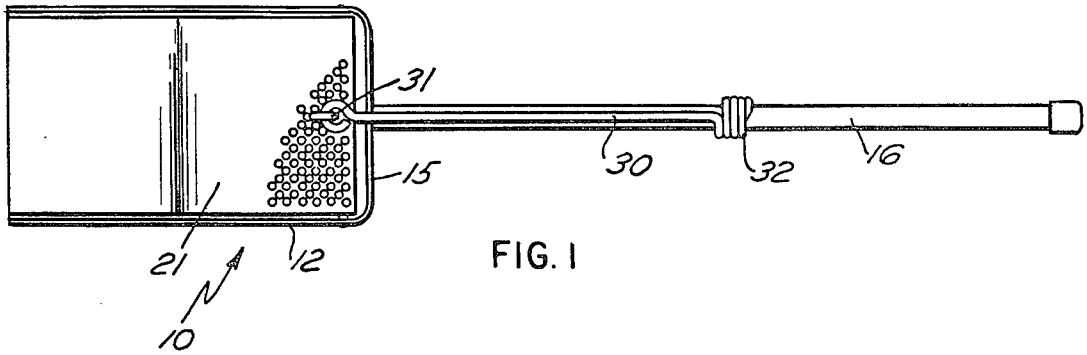
FIG. 1 is a top plan view of the shovel-like device with the cover in closed position.

10 designates generally the body of the device which has a bottom wall 11, side walls 12 extending upwardly from the bottom wall, these side walls being tapered as at 13 toward the front end 14 of the bottom wall. A back wall 15 is also upstanding from the bottom wall and may be substantially the height of the back and side walls. A cylindrical tubular handle 16 is held in a recess 17 in the back wall and may be flattened at its forward end and secured to the back wall 15 and bottom wall 11. A cover designated generally 20 has a top, flat foraminated surface 21 with flanges 22 on either side which may also be of the same foraminated material and which telescope into the side walls 12 of the body. The flat surface 21 of this foraminated material is tapered downwardly as at 24 to follow the taper 13 of the side walls 12 and also the taper of the flanges 22 as at 25 follows this taper so that when the cover is swung about its hinge 26 hinging it to the side walls 12 the tapered surface 24 will form a wedge shape portion so that the body with its cover closed will have a wedge-like entrance into the fire of burning coals or logs and permit the forward edge 14 to scoop up the ashes in the bottom of the burning fire and if any solid materials are also scooped up by reason of this wedge action and slide up onto the outer planar surface 21 of the foraminated cover, the rocking of the entire device by means of a handle will cause any ashes which are on the outer surface of the cover to pass through the cover into the container-like shovel 10 while sufficient rocking or tilting of the entire device will cause the burning solid particles to be slid back into the fire and not be removed therefrom. To achieve this result, the cover may be formed with a plurality of apertures of a diameter on the order of 6 mm.

Figure 2:
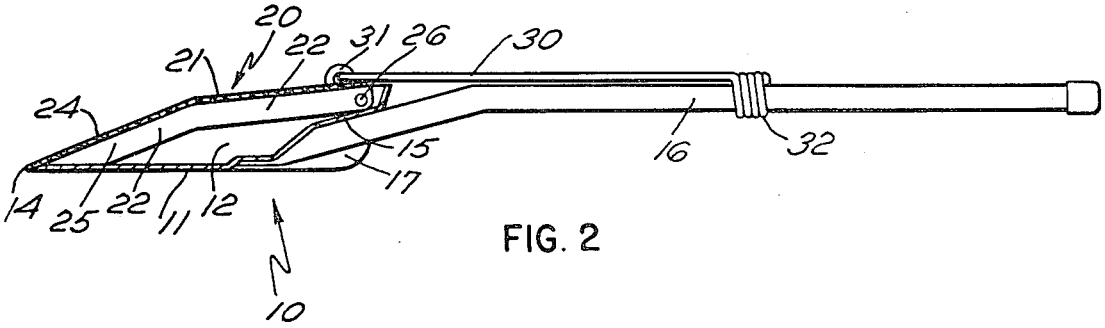
FIG. 2 is a sectional view of FIG. 1.
Figure 3:
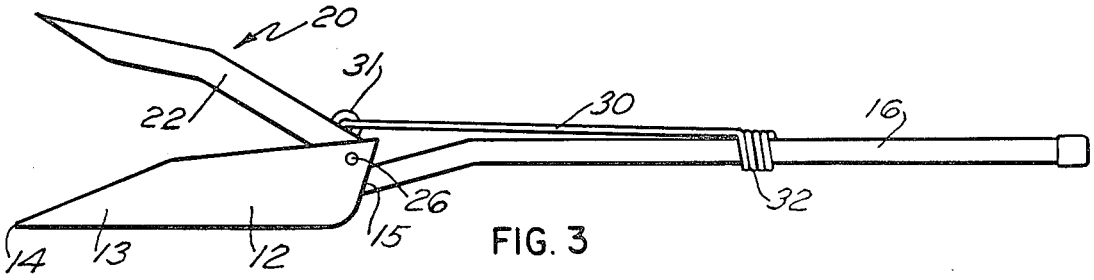
FIG. 3 is a side elevation with the cover in raised position.

The cover may be controlled in its movement from closed position, as in FIG. 2, to open position, as in FIG. 3, by a rod 30 attached at one end to eye 31 secured on the cover and wrapped about the handle as at 32 at its other end sufficiently loosely so that it may be manually grasped and slid along the cylindrical handle to swing the cover to open position. The wrapping may be such that it will frictionally grip the handle and be maintained in the position to which it is moved.

Figure 4:
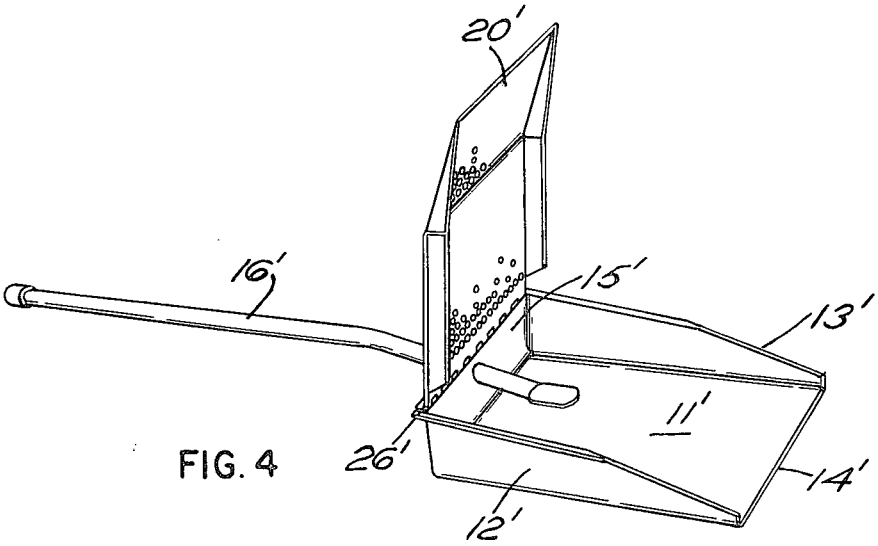
FIG. 4 is a perspective view of a modified form of the device.

In some cases it may not be necessary to control the movement of the cover, and the arrangement as seen in FIG. 4 may be used.

The device as in the previously described embodiment has a bottom wall 11' with side walls 12' and a back wall 15' rising therefrom, the side walls being tapered as at 13' toward the front end 14' of the bottom wall. A foraminous cover 20' may be hinged to the back wall 15' by a piano hinge 26' and a handle 16' is fastened to the bottom wall 11' after passing through the back wall 15' which is provided for operating the device. In operating this particular ash collector, the same is placed into the fire with the foraminated cover 20' closed and the wedge-shaped front portion will be pushed into the ashes in such a way as to collect the same through the apertures in the cover 20', cinders and coals and other material remaining outside of the device and being able to be readily shaken therefrom as the item is withdrawn from the bottom of the fire pit. The device can be moved to an ash container and merely oriented in a vertical attitude and shaken so that the cover 20' will open depositing the ashes into the requisite container.

I claim:

1. A device for removing ashes from a burning fire comprising a shovel-like body, said body having a bottom wall with a front end and a fixed back wall at generally right angles thereto, side walls upstanding from the bottom wall with upper free edges extending therealong and tapered to the front end of the bottom wall, a handle extending rearwardly from the fixed back wall, a top cover separable from the body having an upper surface, means adjacent the handle to pivot said cover with respect to said body, means to support the cover generally parallel to the bottom wall so that its upper surface is no lower than the free edges of the side walls, the upper surface of said cover having unobstructed edges from which solid material may be discharged by inclining the same, said upper surface being foraminated for ashes to pass therethrough into said body whereby the body with the cover closed may be moved into a burning fire to pick up ashes and burning solid material, whereby the shovel may be inclined to the horizontal by the handle without changing the position of the cover to discharge the solid material back into the fire from the foraminated cover and retain the ashes which have passed through the cover to be withdrawn from the burning fire.

2. A device for removing ashes from a burning fire as in claim 1 wherein the cover is hinged to the back end of the body and a rod is attached to the cover and is movable away from the shovel to open the cover.

3. A device for removing ashes from a burning fire as in claim 1 wherein the cover is hinged to the back end of the body and a rod is attached to the cover and is guided along the handle in moving away from the shovel to open the cover.

4. A device for removing ashes from a burning fire as in claim 1 wherein the top cover has a sloping forward end that generally follows the shape of the tapered side walls.

5. A device for removing ashes from a burning fire as in claim 1 wherein the top cover has side flanges telescoping within the side walls of the body.

* * * * *